US005495275A

United States Patent [19]

Martinengo

[11] Patent Number: 5,495,275

[45] Date of Patent: Feb. 27, 1996

[54] HEATING DEVICE FOR FIXING INFORMATION ON AN INFORMATION MEDIUM

[75] Inventor: Elio Martinengo, Rivarolo Canavese, Italy

[73] Assignee: Olivetti-Canon Industriale, Turin, Italy

[21] Appl. No.: 111,874

[22] Filed: Aug. 26, 1993

[30] Foreign Application Priority Data

Aug. 31, 1992 [IT] Italy ..... TO92A0720

[51] Int. Cl.[6] ..... H05B 3/02; G03G 15/20

[52] U.S. Cl. ..... 347/112; 346/25; 347/102; 347/105

[58] Field of Search ..... 355/285, 290; 219/216, 553; 347/105, 102, 112; 338/308, 307; 346/25

[56] References Cited

U.S. PATENT DOCUMENTS 4,511,268 4/1985 Marshall ..... 400/119

4,761,541 8/1988 Batliwalla et al. ..... 219/528

FOREIGN PATENT DOCUMENTS

0426072A2 5/1991 European Pat. Off. .

*Primary Examiner*—Benjamin R. Fuller
*Assistant Examiner*—Raquel Yvette Gordon
*Attorney, Agent, or Firm*—Banner & Allegretti, Ltd.

[57] ABSTRACT

A heating element (30) for a device for fixing images in photocopiers or information printed by a printer on media (12) having different formats is formed by a layer of resistive material having a negative temperature coefficient (NTC), so that, in the portion of the heating element (30) not covered by a medium of any smaller format, the quantity of heat supplied and the temperature of the heating element are automatically adjusted without the use of a special control circuit.

5 Claims, 3 Drawing Sheets

HEATING DEVICE FOR FIXING INFORMATION ON AN INFORMATION MEDIUM

FIELD OF THE INVENTION

The present invention relates to a heating device for fixing information on an information medium having different formats.

BACKGROUND OF THE INVENTION

A heating device embodying the invention is particularly suitable for indelibly fixing on a sheet of paper, or any any other convenient medium, information transferred either following the development of latent images with a toner or following printing with an ink which has to be dried rapidly. In the case of fixing information developed with a toner, the heating device is applied in the fixing equipment or fuser in a copier or printer of the type comprising a belt having low thermal inertia, generally consisting of an electrical resistance element held by a support disposed perpendicularly with respect to the direction of advance of a copy sheet in the fuser.

European patent application no. 426,072 describes image fixing equipment for a electrical photocopier in which the heating element consists of a principal strip of resistive material whose length is at least equal to the transverse dimension of the largest paper format.

The heating element is heating by applying a suitable direct or alternating voltage to its ends so that the current passing through it generates, by the Joule effect, the amount of heat necessary to fuse and fix the toner on the paper.

When paper formats smaller than the maximum size are used, a portion of the heating element remains uncovered by the paper and is in contact with the fuser advance belt. To avoid losses of electrical energy and possible damage due to the high temperature of the heating element, according to the cited European patent, auxiliary parallel resistive strips are disposed beside the principal strip. These auxiliary strips are connected selectively in parallel with the principal strip at points along its length corresponding to the various paper formats in use. A control circuit is used to connect one or more of the auxiliary strips in parallel with the principal strip, according to,the preselected format.

The heat generated by the principal strip in the part not covered by the paper is thus less than the nominal value required for fixing.

In this arrangement, the number of formats which may be used is limited to 3 or 4, since the width of the support of the auxiliary resistive strips would become excessive. Moreover, the size of each usable format is constant, and it is impossible to use arbitrary paper formats not specified at the design stage.

SUMMARY OF THE INVENTION

Preferred embodiments of the present invention provide a selective heating element suitable for fixing information on a medium, for example a sheet of paper of arbitrary format smaller than the maximum specified format, wherein the temperature of the heating element is automatically controlled in areas not covered by the paper, without the use of a special control circuit.

Accordingly, a preferred embodiment of the present invention provides a heating element of resistive material in which the material has a negative temperature coefficient of resistance.

The invention is defined, with more precision, in the appended claims to which reference should now be made.

BRIEF DESCRIPTION OF THE DRAWINGS

Preferred embodiments of the invention will now be described in detail, by way of example, with reference to the accompanying drawings, in which.

DETAILED DESCRIPTION OF PREFERRED EMBODIMENTS

Figure 1:
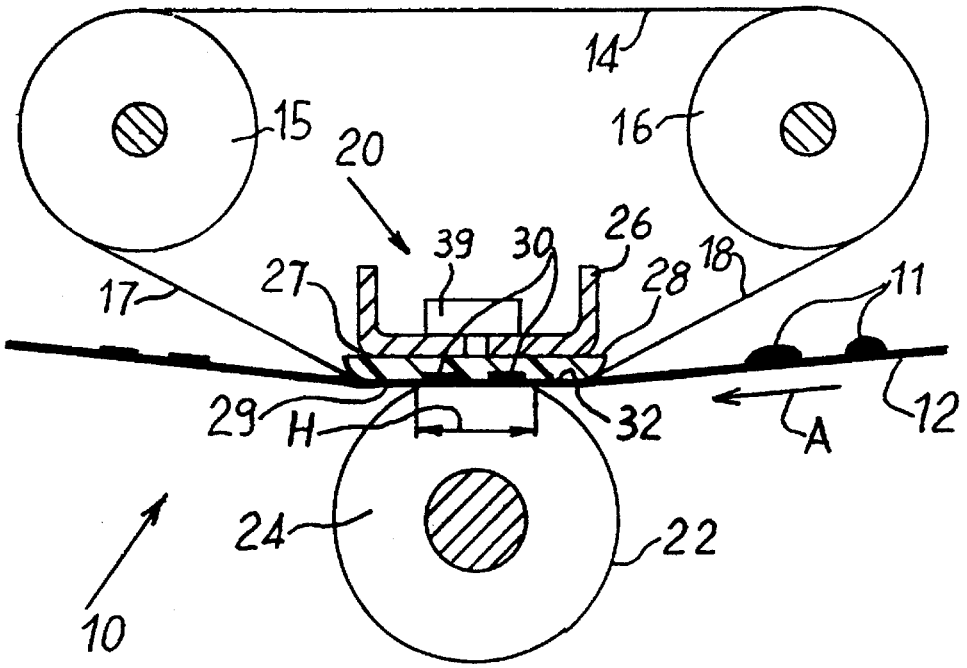
FIG. 1 is a schematic representation of a belt-type fuser using a selective heating device embodying the invention.

FIG. 1 shows a heat fixing device 10 or fuser for an image developed with particles of toner 11 on a sheet of paper 12 by a known reprographic process.

A continuous belt 14 is passed around two rollers 15, 16 which are rotatable and parallel to each other.

The belt 14 consists of a material based on flexible polyimide and resistant to heat, for example "KAPTON" (DUPONT Registered Trade Mark) having a thickness of approximately 25 microns.

One of the two rollers, for example the roller 15, is the driving roller, while the roller 16 rotates freely, and is caused to rotate by the belt 14.

The fixing device 10 comprises a fuser assembly 20 fixed to the structure of the copier and extending transversely with respect to the belt 14 in a direction parallel to the rollers 15 and 16, and consequently perpendicular to the movement of the belt 14.

The fuser assembly 20 is disposed inside the belt 14 and, together with the rollers 15, 16 helps to keep it under tension.

A pressure roller 22 covered with a thick layer 24 of soft rubber is disposed next to the assembly 20 and outside the belt 14.

The roller 22 is pressed against the fuser 20 so that it forms a compressed contact area with an appropriate width "H", as will be shown below.

The sheet of paper, carrying toner particles on its upper surface nearer the fuser 20, is advanced between the pressure roller 22 and the outer surface 17 of the belt 14 in the direction indicated by the arrow "A".

The width "H" is obtained by compression of the covering material of the roller 22, and also depends on the diameter of the roller 22.

Owing to the limitations on the overall dimensions of the roller 22 and the low value of the yield point of the covering rubber, the width "H" does not generally exceed 10–15mm.

These conditions limit the use of a large number of auxiliary resistive strips, as described in the previously cited European patent application, and consequently the number of formats of the information medium is limited.

To avoid these limitations the heating device comprises a heating element 30 (FIGS. 1 and 2) consisting of a single strip of resistive material having a negative temperature coefficient (NTC).

As is known, this material consists of a paste which may be applied by silk-screen printing and which contains metallic particles, for example silver and palladium, mixed with a suitable resin.

The heating element 30, in the form of a rectilinear strip, is disposed perpendicularly to the direction of advance A of the paper and has a transverse length slightly greater than the maximum dimension L max (FIG. 2) of the paper which may be used, measured in the direction perpendicular to the direction A.

On application of a suitable voltage V across the heating element 30 (NTC), the current passing through it causes the resistive strip to be heated to a temperature T2 necessary for the fusion of the toner, for example T2=200° C.

The heat generated by the Joule effect is controlled in a known way by a regulating system which is not shown, and with the aid of a temperature sensor 39 situated in the area which is constantly next to the sheet of paper 12.

As a result of the heating, at the temperature T2 the resistance of the element 30 changes from an ambient temperature value R1 to an operating value R2 which is much less than R1, for example by a factor of 10.

On the passage of a sheet of paper of smaller format L (FIG.2), the temperature of the section 26 of element 30 which is not covered by the paper ends to rise further, since the heat generated there is not absorbed by the paper.

Consequently, the resistance of this section 36 of element 30 decreases further, but since the mean power supplied to the section 35 of element 30 in contact with the paper is not changed, as a result of the control, the power dissipated in the form of heat in the section 36 which is not covered by the paper is reduced.

In this way, the temperatures of the element 30 in the area 35 covered by the paper and in the area 36 not covered by the paper are rapidly stabilised and differ from each other by a limited amount, for example 20°–30° C. so that hazardous strains are not created in the belt 14.

The fuser 20 (FIG. 1) consists of a narrow support 26 elongated transversely with respect to the direction of advance A.

A plate 28 of refractory material, for example alumina, is fixed to a lower surface 27 of the support 26.

The heating element 30, which, as stated previously, consists of at least one track 30 of resistive material with a negative temperature coefficient (NTC), is deposited by a known silk-screen method on the lower free surface 29 of the plate 28.

The track 30 faces the inner surface 18 of the belt 14 and is protected from wear by a thin layer 32 of glass or other similar protective material.

Figure 4:
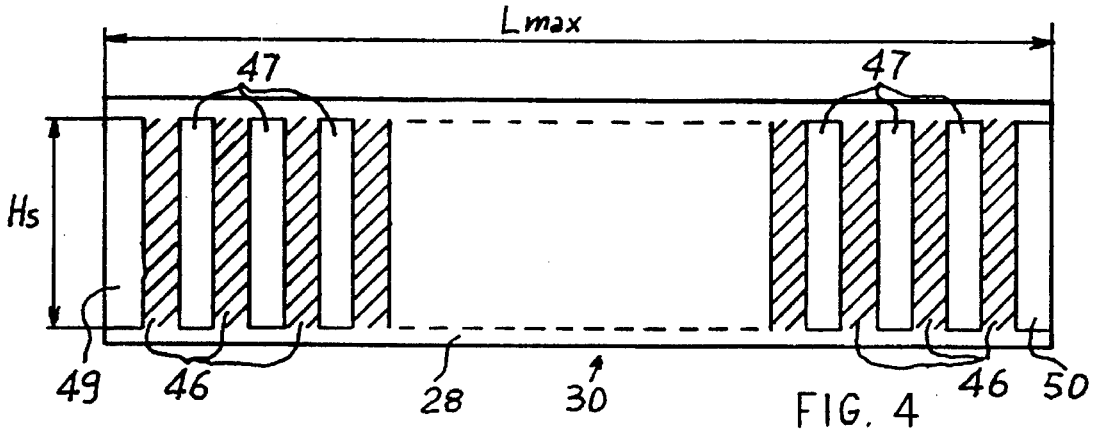
FIG. 4 shows an embodiment of the heating device of FIG. 2.

FIG. 4 shows in greater detail a preferred, non-restrictive embodiment of the heating element 30.

As noted previously, the heating element 30 is formed by silk-screen deposition of an elongated layer of a resistive paste or varnish having a negative temperature coefficient (NTC).

The resistive varnishes (NTC) normally available on the market have a relatively high specific surface resistance Rs, of the order of 1,000–10,000 ohms, so that a heating element formed from a single strip would have a total resistance too high for use a heating element for a fixing device.

To avoid this difficulty, use is made of a property of resistive varnishes, particularly of the NTC type, owing to which their specific resistance can be interpreted as the resistance offered by a layer of square section measured between two opposite sides of the square. This specific resistance is constant regardless of the variations of the dimensions of the square.

Figure 3:
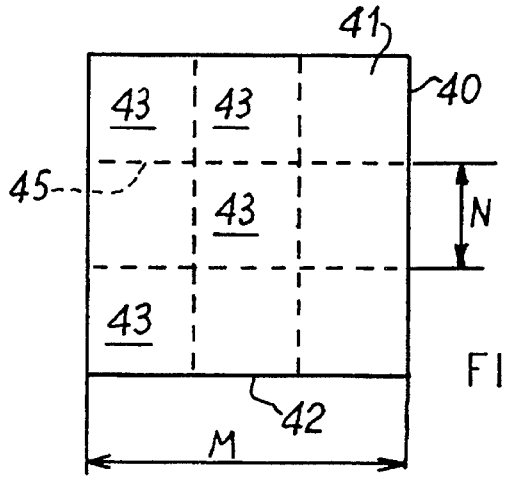
FIG. 3 is a diagram illustrating the electrical behaviour of the heating element of FIG. 2.

FIG. 3 shows, for example, a square 40 with a side M, formed with a layer of resistive varnish (NTC) having a specific resistance Rm measured between two opposite sides 41 and 42.

Let the square 40 be divided into any whole number of smaller squares, all of equal size, for example into nine squares 43, each having a side N=⅓ M, and having a specific resistance Rn.

The resistance measured between two longer and opposite sides of each horizontal row, for example between the sides 41 and 45, will be ⅓ Rn, since the three squares 43 in each row are disposed in parallel with respect to the direction from side 41 to side 45.

The total resistance of the three rows of squares 43, in other words between the sides 41 and 42, is given by the sum of the resistances of each row and is: 3⅓ Rn-Rm. Therefore the specific resistance of the large square 40 is the same as that of each small square 43.

Figure 2:
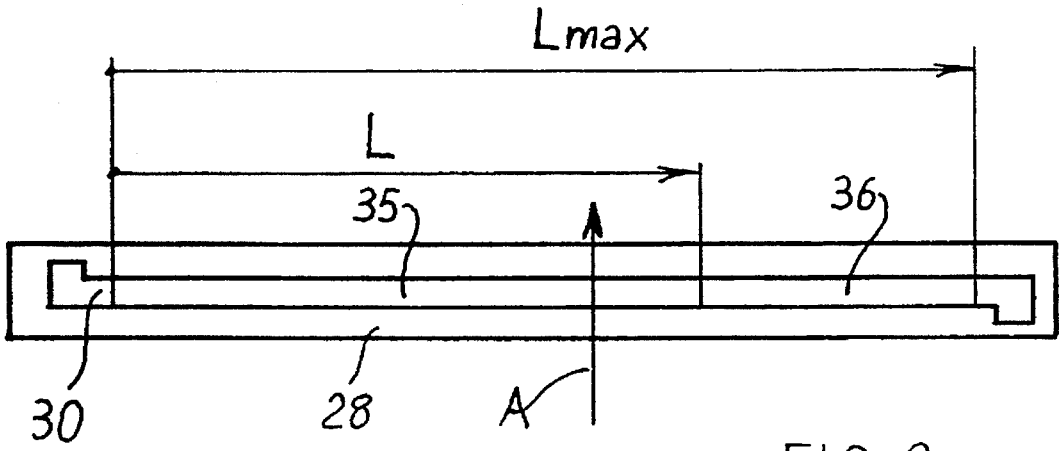
FIG. 2 shows the heating device of FIG. 1.

Because of this property of resistive varnishes, and in order to obtain a very small total resistance, the heating element 30 in FIG. 4 is made by depositing on a support 28 a first plurality of parallel resistive strips 46, each separated from the next by a layer of electrically conducting material 47. The strips 46 are disposed on the plate 28 (FIGS. 2 and 4) parallel to the direction A of advance of the sheet 12 (FIGS. 1 and 2). If a voltage V is applied between the ends 49 and 50 in FIG. 4, the heating element 30 acts as a resistor formed by the connection in series of the strips 46 located between the ends 49 and 50.

Each strip, in,turn, may be considered as comprising a second plurality of square resistive elements 52, or resistive units with a side measurement equal to the width "b" of each strip, so that the resistive units 52 of each strip, each having a specific resistance Rs, are connected in-parallel to each other. Therefore, if "P" denotes the number of strips 46 forming the heating element 30 located between the ends 49 and 50, and "q" denotes the number of resistive units 52 in each strip 46, the total resistance Rt of the element 30 between the ends 49 and 50 may be calculated by the expression:

$$Rt=P/q\ Rs$$

where Rs is the specific resistance of each resistive unit 52.

It is evident that, by varying the number of parallel strips 46 and their length "Hs", it is possible to obtain very many combinations of series and parallel connections of the resistive units 52, thus obtaining a very wide range of total resistances Rt of the heating element 30.

In particular, the length "Hs" of each layer may be considerably increased by disposing it in a position inclined at an angle between 0° and 90° (FIGS. 5 and 6) to the longitudinal axis X of the support plate 28, the axis X in turn being perpendicular to the direction A of advance of the paper. With this arrangement, it is possible to obtain a heating element 30 (FIG. 5) contained in a very narrow band S having a width not greater than approximately 10mm.

Figure 5:
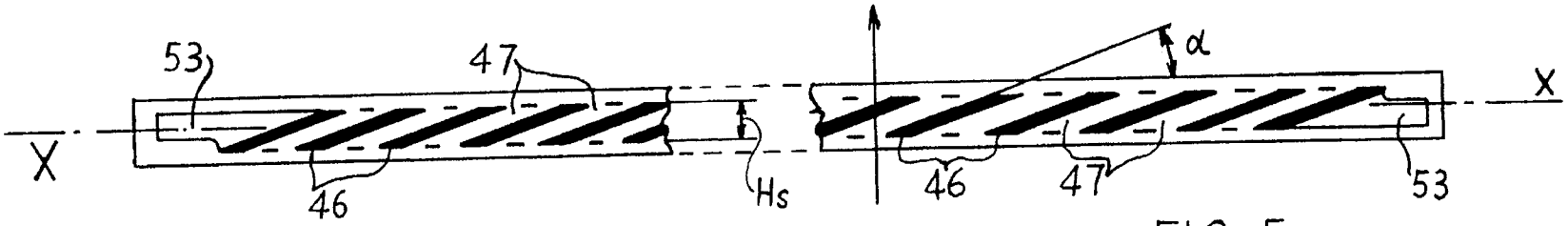
FIG. 5 shows a variant embodiment of the heating device of FIG. 4.
Figure 6:
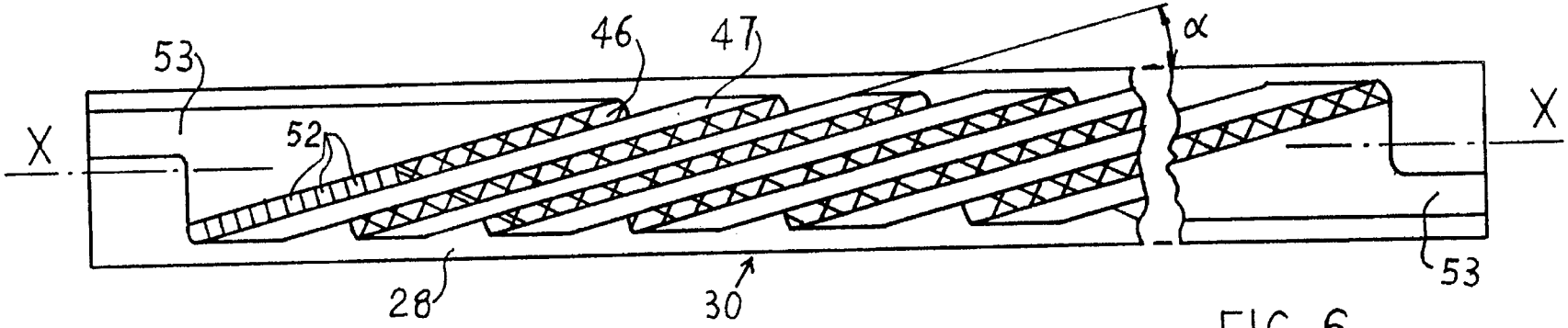
FIG. 6 is a detail of FIG. 5.

In FIGS. 5 and 6, 53 indicates the end areas to which a voltage V is applied.

A heating element embodying the present invention may also be applied to other office equipment or machines in which it is a requirement to locally heat any information medium, for example a sheet of paper on which the information has been printed with an ink which has to be dried rapidly.

Figure 7:
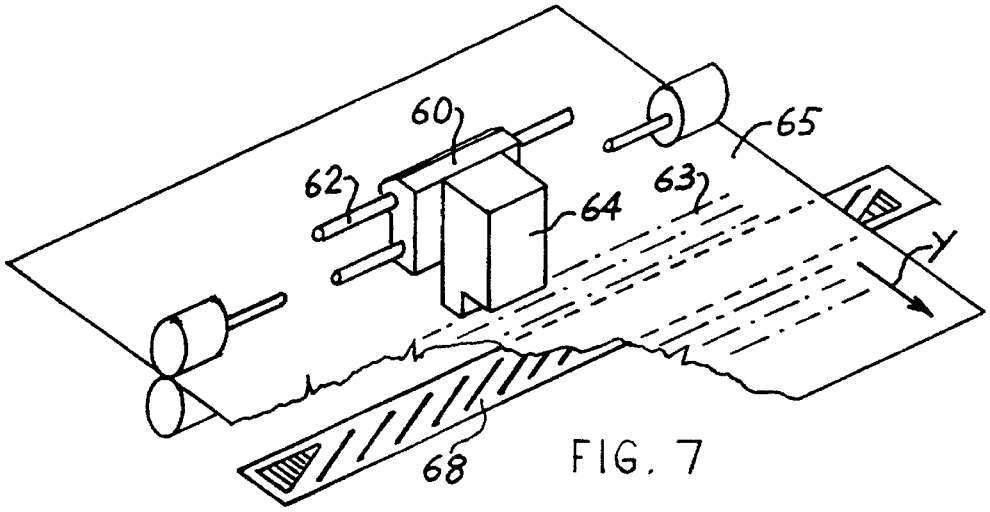
FIG. 7 shows an application of the heating device of FIG. 5 in an office machine.

In particular, the heating element may be conveniently used in an ink-jet printer shown schematically in FIG. 7.

An ink-jet print head 64 is mounted on a carriage 60 which slides on guides 62. The head 64 prints information along the printing lines 63 on a print medium, for example a sheet of paper 65, movable in the direction Y perpendicular to the movement of the carriage 60.

The print head 64 uses any type of ink suitable for the thermal, piezoelectric or other type of process of expulsion of ink droplets known in the present art.

For rapid drying of the ink disposed on the paper, a heating element 68 is disposed downstream of the print area, in the direction Y of advance of the paper 65.

The heating element 68 is of the type described previously with reference to FIGS. 4 and 5, and is disposed in contact with the lower face of the sheet 65, opposite that containing the printed information.

A heating element embodying the invention may also be used to reveal information applied by a cryptographic method, for example with magnetic inks which are not visible at ambient temperature but which become visible when subjected to a source of heat.

It is to be understood that the selective heating element for the fixing of information on sheets of different formats may be subjected to variations, additions or replacements of parts or variations of form without thereby departing from the scope of the present invention.

For example, the heating element may be deposited on both faces of the support 28.

The heating element may also be deposited in forms different from rectilinear strips, for example in curved tracks or in broken lines or in a Greek key shape or in any other form.

Finally, the heating element of the NTC type may be associated with another heating element of the type having a positive or zero temperature coefficient, deposited on an opposite face of the support, or on the same face, but separated by an insulating layer, to enable the thermal operating condition to be reached rapidly.

In another embodiment, the support 28 is a printed circuit board, covered on one or both faces by an electrically conducting layer, suitably incised to form contiguous, but electrically separate, conducting areas. The resistive layer 30, deposited continously over the conducting layer, therefore short-circuited where there are underlying conducting areas, but forms resistive strips in the separating parts of the conducting layer.

I claim:

1. A heating device for fixing information on an information medium comprising:

a thermally and electrically insulating support plate, a heating element of electrically resistive material disposed on said plate, said heating element having conductive ends of a first electrically conductive material for applying a voltage to said heating element, temperature detecting means to sense the temperature of said heating element, and regulating means responsive to said temperature detecting means to regulate said voltage, wherein said resistive material has negative temperature coefficient and said heating element comprises a layer of said resistive material deposited on said support plate in a plurality of parallel resistive strips, a layer of a second electrically conductive material also deposited on said plate in a plurality of parallel conductive strips interposed between adjacent resistive parallel strips, each of said conductive strips being physically and electrically separated from one another and from said conductive ends, whereby in combination said resistive and conducting parallel strips form a single resistive element.

2. A heating device according to claim 1 in which said support plate has a rectilinear shape elongated along a longitudinal axis, wherein said parallel strips are rectilinear and inclined at an angle of between 0° and 90° to said longitudinal axis of said plate.

3. A heating device for fixing information on an information medium comprising:

a thermally and electrically insulating support plate, a heating element of electrically resistive material disposed on said plate, said heating element having conductive ends of a first electrically conductive material for applying a voltage to said heating element, temperature detecting means to sense the temperature of said heating element, and regulating means responsive to said temperature detecting means to regulate said voltage, wherein said resistive material has a negative temperature coefficient and said heating element comprises:

a layer of a second electrically conductive material deposited on said support plate, said conductive layer forming a plurality of contiguous conductive areas separated electrically from another and from said conductive ends, and a continuous layer of said resistive material deposited on said layer, whereby said conductive areas short-circuit corresponding resistive areas overlaying said conductive areas and in combination said resistive and conductive areas form a single resistive element.

4. A heating device for a fixing equipment in an electric photocopier for fixing information developed on an information medium, comprising:

a support plate, a heating element comprising a layer of electrically resistive material disposed on said support plate to generate heat upon application of a voltage to conductive ends of said element, temperature detecting means to sense the temperature of said heating element, regulating means responsive to said temperature detecting means to regulate said voltage applied to said heating element; and a belt which is movable together with said medium and has an inner surface in contact with said heating element and an outer surface in contact with said information medium, whereby said developed information is heated and fixed on said information medium by heat generated by said heating element through said belt;

wherein said resistive material has a negative temperature coefficient, and said layer is disposed on said support in a plurality of resistive parallel strips separated by a plurality of conductive parallel strips of an electrically conductive material, each of said conductive strips being physically and electrically separated from one another and from said conductive ends.

5. A heating device for fixing information printed by an ink-jet printer on a face of an information medium, comprising:

a support plate, a heating dement comprising a layer of electrically resistive material disposed on said support plate, said heating dement being disposed in contact with said information medium on an opposite face of said information medium to generate heat with application of a voltage to conductive ends of said element, temperature detecting means to sense the temperature of said heating element, regulating means responsive to said temperature detecting means to regulate said voltage applied to said heating element, an ink-jet print head movable along a printing line; and means to advance said information medium in a direction perpendicular to said printing line, said heating element being fixed downstream of said ink-jet print head with respect to a direction of advance of said information medium, wherein said resistive material has a negative temperature coefficient and said layer is disposed on said support in a plurality of resistive parallel strips separated by a plurality of conductive parallel strips of an electrically conductive material, each of said conductive strips being physically and electrically separated from one another and from said conductive ends.

* * * * *